US008881312B2

(12) United States Patent
Zuccarello

(10) Patent No.: US 8,881,312 B2
(45) Date of Patent: Nov. 11, 2014

(54) DISPOSABLE BIB

(76) Inventor: Joseph Zuccarello, Dardenne Prairie, MO (US)

( * ) Notice: Subject to any disclaimer, the term of this patent is extended or adjusted under 35 U.S.C. 154(b) by 16 days.

(21) Appl. No.: 13/532,059

(22) Filed: Jun. 25, 2012

(65) Prior Publication Data

US 2013/0042379 A1 Feb. 21, 2013

Related U.S. Application Data

(60) Provisional application No. 61/523,777, filed on Aug. 15, 2011.

(51) Int. Cl.
*A41B 13/00* (2006.01)
*A41B 13/10* (2006.01)

(52) U.S. Cl.
CPC ..... *A41B 13/10* (2013.01); *A41B 2400/52* (2013.01)
USPC ..... 2/49.1

(58) Field of Classification Search
USPC ..... 2/49.1, 49.2, 49.4, 49.5
See application file for complete search history.

(56) References Cited

U.S. PATENT DOCUMENTS

| | | | | |
|---|---|---|---|---|
| 593,618 | A | 11/1897 | Stackhouse | |
| 889,073 | A | 5/1908 | Walbridge | |
| 2,164,369 | A | 7/1939 | Woolever | |
| 2,523,565 | A | 9/1950 | Gardner | |
| 2,651,039 | A | 9/1953 | Tonkens | |
| 2,783,472 | A | 3/1957 | Lenger | |
| 3,010,110 | A | 11/1961 | Kirk | |
| 3,286,279 | A | 11/1966 | Brown | |
| 3,540,060 | A | 11/1970 | Brown | |
| 3,979,776 | A | 9/1976 | Gruenwald | |
| 4,753,647 | A | 6/1988 | Curtis | |
| D380,829 | S | 7/1997 | Breault | |
| 5,875,490 | A | 3/1999 | Woodard | |
| D416,663 | S | 11/1999 | Thomas | |
| 6,000,056 | A | 12/1999 | Brady | |
| 6,219,846 | B1 | 4/2001 | Toole | |
| 7,013,916 | B1 * | 3/2006 | Pearlstein et al. | 137/613 |
| 7,269,855 | B2 * | 9/2007 | LaRocco | 2/49.1 |
| D560,802 | S | 1/2008 | Stratton | |
| 7,448,089 | B2 | 11/2008 | Kelly | |
| D631,232 | S | 1/2011 | Lewis | |
| 2001/0047532 | A1 * | 12/2001 | Marrero | 2/49.1 |
| 2004/0205876 | A1 * | 10/2004 | Bruffett | 2/49.2 |
| 2004/0216208 | A1 * | 11/2004 | Austin | 2/49.1 |
| 2006/0059597 | A1 * | 3/2006 | LaRocco | 2/49.1 |
| 2007/0006357 | A1 | 1/2007 | Hall | |
| 2007/0061938 | A1 * | 3/2007 | Reimer | 2/48 |
| 2007/0061939 | A1 * | 3/2007 | Rose | 2/49.1 |

(Continued)

*Primary Examiner* — Amber Anderson
(74) *Attorney, Agent, or Firm* — CreatiVenture Law; Linda L. Lewis

(57) ABSTRACT

A disposable bib having a flexible bib body to cover at least a portion of the user's torso, wherein the bib body has a torso side and an outward side; at least one fastener attached to the bib to attach the bib to the user; an absorbent wipe fixably attached to the outward side of the bib body where the wipe is spread approximately flat and is ready to use; and a releasable cover sealingly attached to the body of the bib on the border that fully covers the wipe; wherein the cover fully encloses and seals the wipe; wherein the cover can be partially or fully removed from the bib body by pulling down, thereby exposing the wipe, and wherein the wipe can be manipulated while attached to the bib body to clean the user.

17 Claims, 6 Drawing Sheets

(56) References Cited

U.S. PATENT DOCUMENTS

2007/0174942 A1* 8/2007 Fleury ..... 2/49.1
2007/0199123 A1* 8/2007 Friedland et al. ..... 2/49.1
2007/0250979 A1 11/2007 Han
2009/0188016 A1* 7/2009 Arthur-Mensah et al. ..... 2/49.4
2009/0270829 A1* 10/2009 Hameed et al. ..... 604/385.06

* cited by examiner

DISPOSABLE BIB

This application claims the benefit of provisional patent application No. 61/523,777 filed Aug. 15, 2011, entitled "Disposable Bib".

FIELD OF THE INVENTION

The field of the invention is disposable bibs. This field includes baby bibs and adult bibs, for personal use or in the field of dental or medical care. It includes bibs suitable for use in nursing homes and care for the elderly.

BACKGROUND OF THE INVENTION

The use of disposable bibs is well known, however the use of disposable bibs with disposable wet wipes to clean the hands and face of the bib user typically involves the opening the wipe package, unfolding the wipe and using the wipe to clean up. The present invention provides a disposable bib that includes a wet wipe that is spread flat and sealingly covered with a releasable cover. When the cover is removed by pulling down, the wipe is ready to use.

SUMMARY OF THE INVENTION

The invention is a disposable bib having a flexible bib body of optionally approximately rounded shape to cover at least a portion of the user's torso, wherein the bib body has a torso side and an outward side; at least one fastener attached to the bib to attach the bib to the user; an absorbent wipe fixably attached to the outward side of the bib body where the wipe is spread approximately flat and is ready to use; wherein the edges of the wipe are within the edges of the bib body so that there is a border of the bib body around the wipe, providing a surface for attachment; and a releasable cover sealingly attached to the body of the bib on the border that fully covers the wipe; wherein the cover fully encloses and seals the wipe; wherein the cover can be partially or fully removed from the bib body by pulling down, thereby exposing the wipe, and wherein the wipe can be manipulated while attached to the bib body to clean the user. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
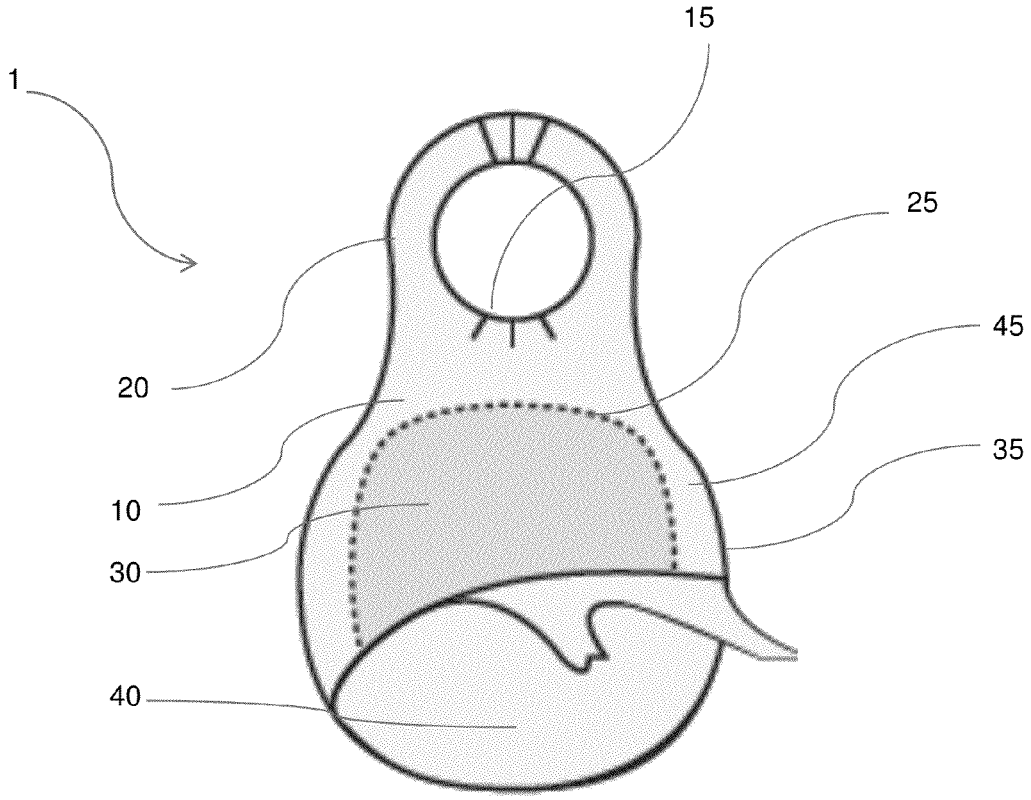
FIG. 1 is a perspective drawing of an embodiment of the invention.
Figure 2:
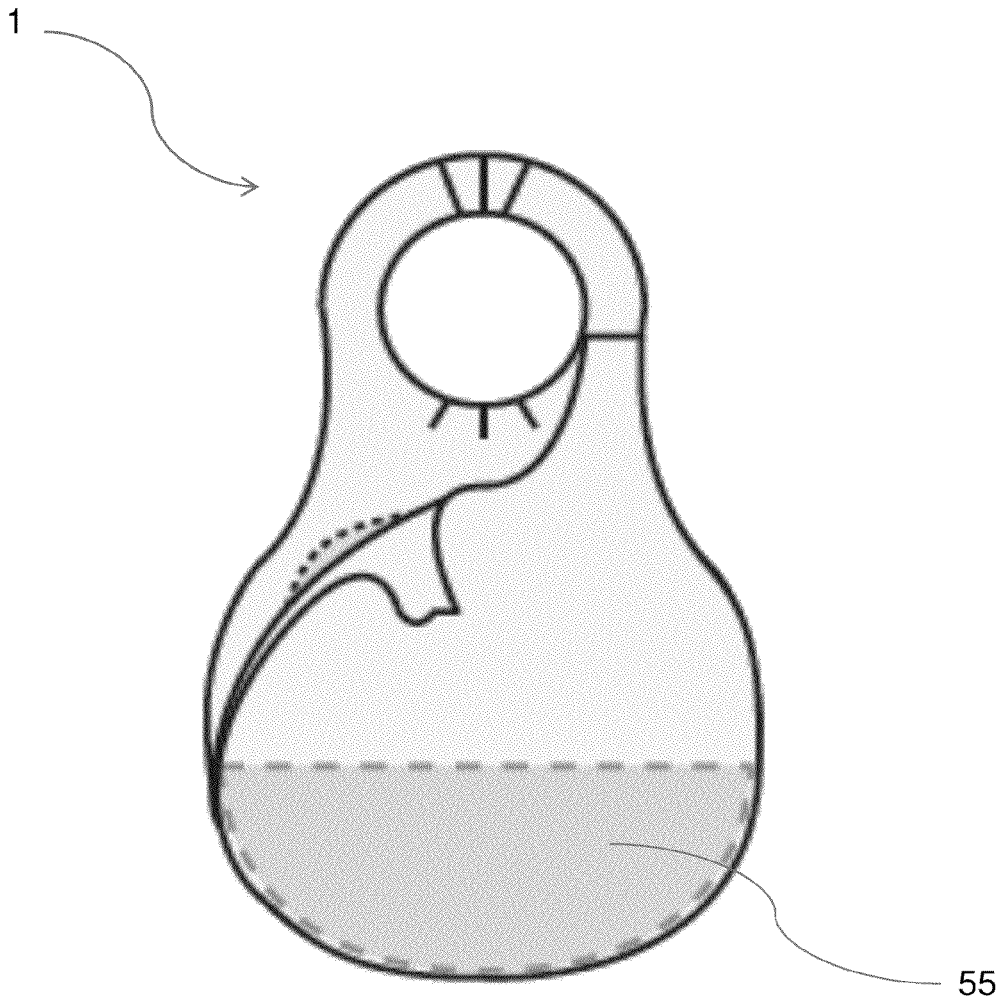
FIG. 2 is a perspective drawing of an embodiment of the invention.
Figure 3:
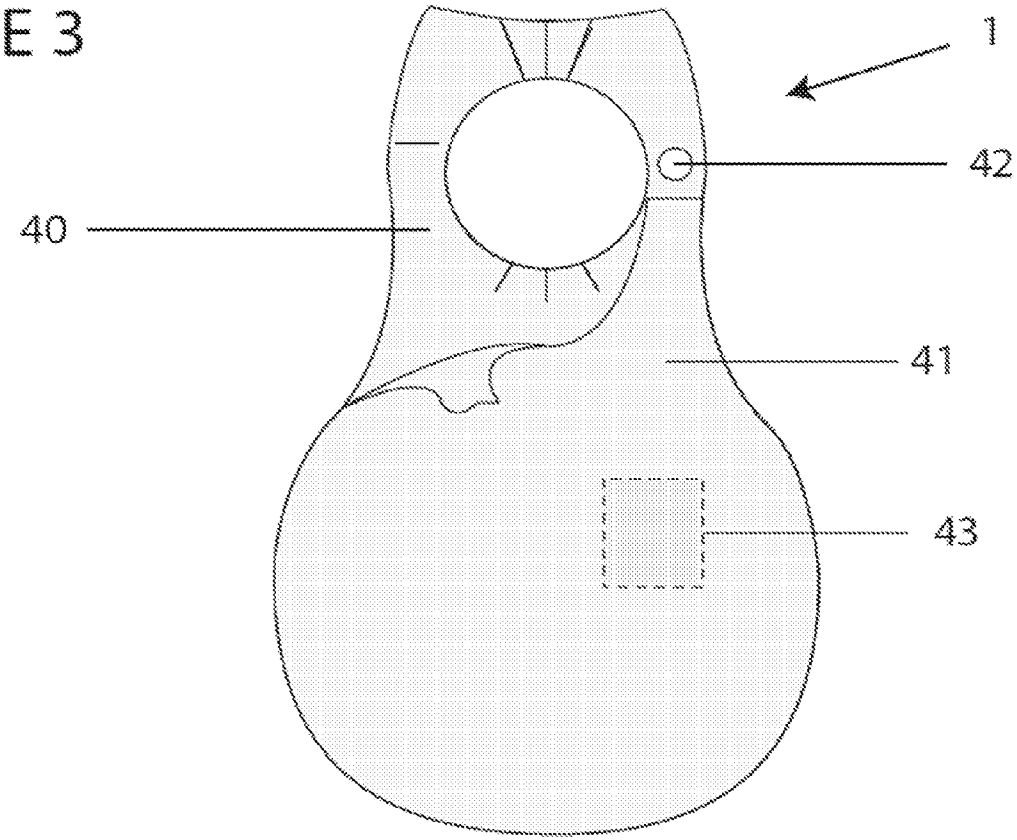
FIG. 3 is a perspective drawing of an embodiment of the invention.
Figure 4:
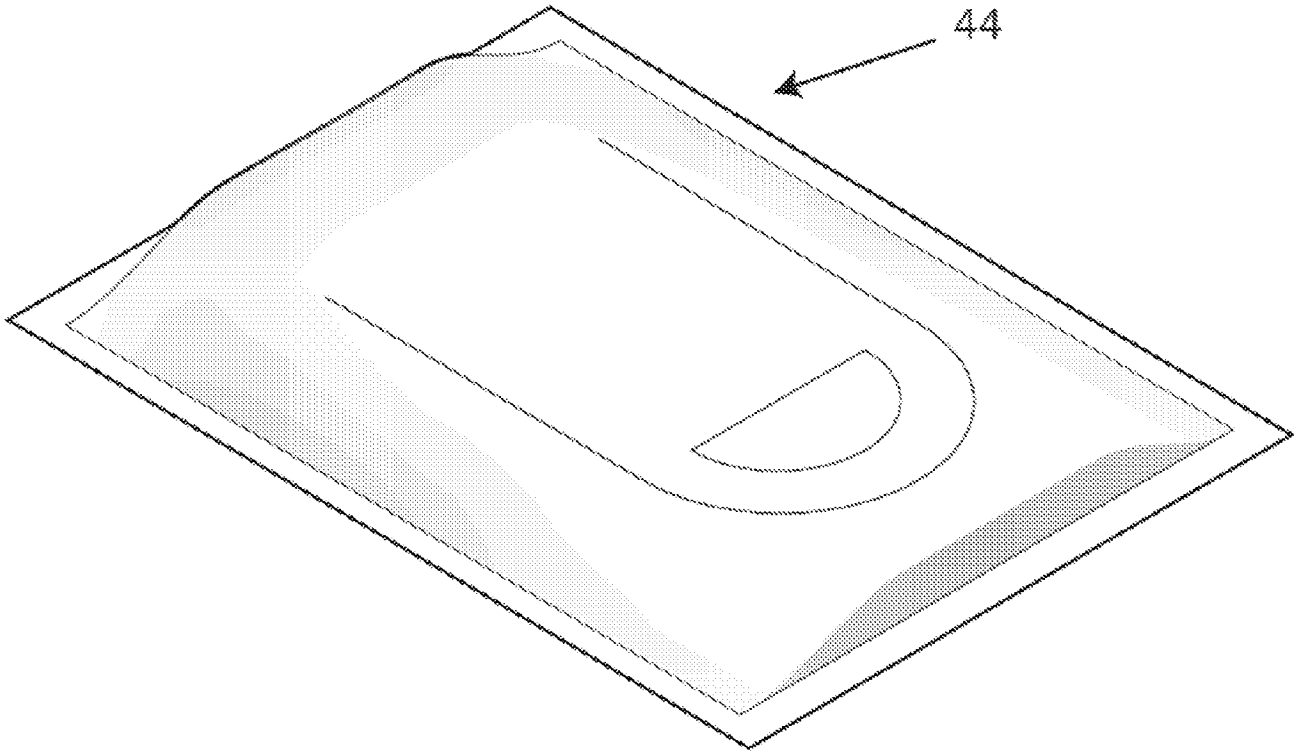
FIG. 4 is a perspective drawing of an individual package of the invention.
Figure 5:
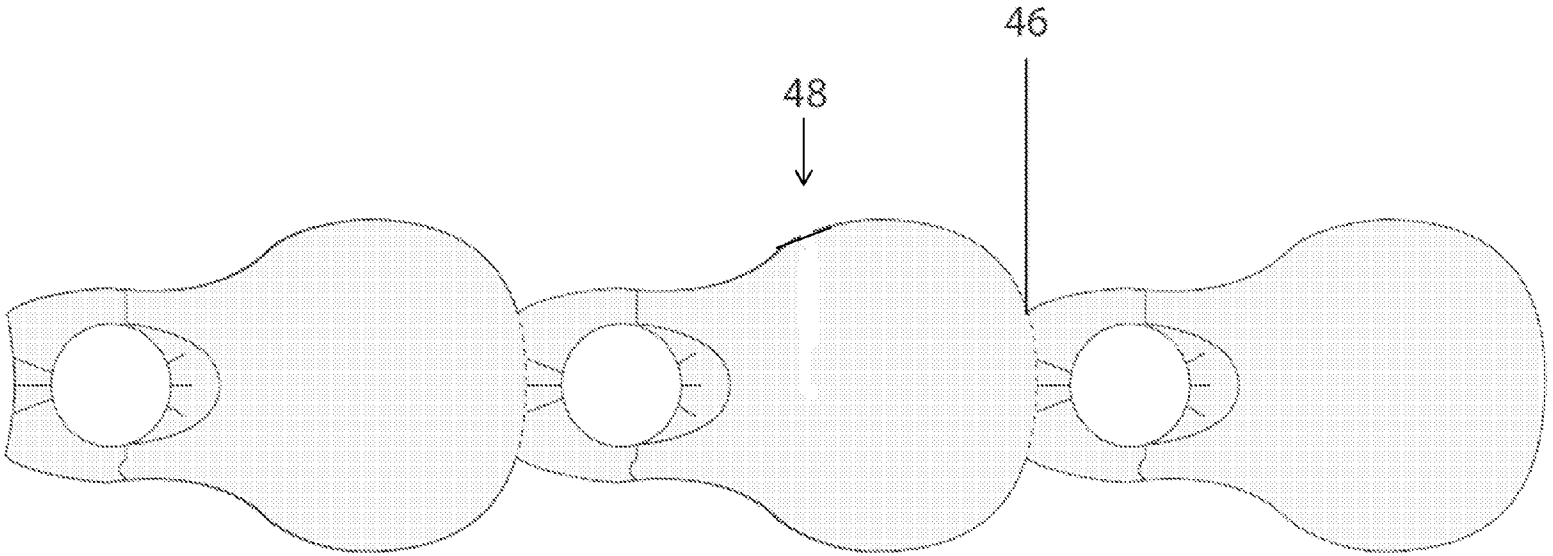
FIG. 5 is a perspective drawing of an embodiment of the invention.
Figure 6:
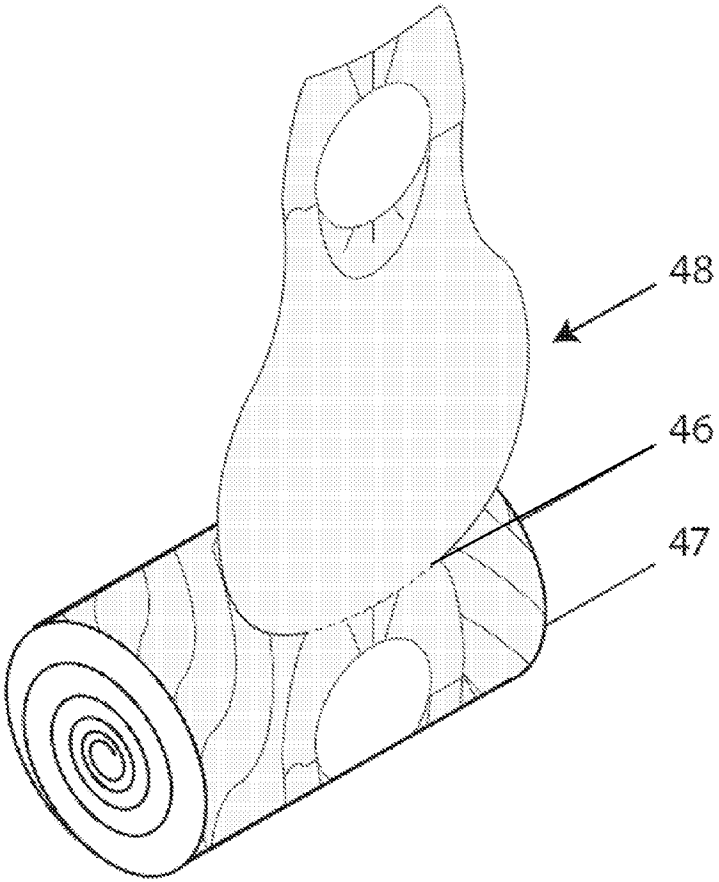
FIG. 6 is a perspective drawing of an embodiment of the invention.

An embodiment of the present invention is disclosed in FIG. 1. The disposable bib 1 is shown having an approximately flat bib body 10 of approximate rounded shape with a torso side and an outward side. Other shapes are considered in the present invention, including oval, square and rectangular. The bib body 10 is made of flexible material that is disposable and is preferably water-impermeable, such as polyethylene or other plastic, reinforced paper or fabric. It is desirable to have the material to be water-impermeable because the bib body 10 shields the user from liquids spilled on the outward side of the bib body and because it works with the releasable cover 40 to enclose the wipe 30 and keep the wipe 30 wetted. The bib body 10 has an edge 35. The edge 35 of the bib body extends beyond the edge 25 of the wipe 30, forming a border 45. The wipe 30 is a flexible absorbent material that is sufficiently thick to retain and be wetted by liquids such as water, alcohol or detergents. Like the bib body, it is made of a disposable material. It is desirable that the wipe 30 remain wetted and not dry out before using. The wipe is spread approximately flat and is ready to use. It is attached fixably to the bib body 10 by adhesives such as hot melt or pressure sensitive adhesive.

The wipe 30 is entirely covered by releasable cover 40 which extends beyond the edges 25 of wipe 30 and is releasably sealed to the bib body 10 along the border 45. The releasable cover 40 has a wipe side and an outward side. Optionally, the wipe side is made of water-impermeable material that prevents the wipe from drying out. Optionally, the outward side of the cover 40 may also be made of water-impermeable material. In another embodiment, the outward side of the releasable cover 40 is made of absorbent material that absorbs liquids that are spilled onto the bib 1. The releasable cover 40 is attached to the bib body 10 on the border 45 with releasable adhesive, such as pressure sensitive adhesive, so that the wipe 30 is entirely enclosed and is sealed entirely by water-impermeable material.

After the bib 1 has been used and the outward side of the bib cover 40 has been soiled, the cover 40 can be completely or partially removed, exposing the wipe 30, attached to the bib body 10. The bib body 10 can be manipulated to use the wipe to clean the use's hands or face as needed. The entire soiled bib 1, with the wipe and the cover 40, can then be all disposed of.

Optionally, a second absorbent cover 41 can be placed over removable cover 40 by adhesive or by laminating. This second absorbent cover is contemplated when the removable cover 40 does not have an absorbent outward side. The second cover is removable with the cover 40 to expose the wipe 30.

The bib 1 has at least one fastener 20. Typically, the fastener 20 is two straps that encircle the neck and fasten by tying, adhesive, snaps, hooks, buttons or VELCRO® loop and hook fasteners (not shown). Alternatively, the fastener is an unbroken circle that loops over the head of the user. The circle is either large enough to pass over the head, or is made of elastic material. The fastener can also be one long strap that encircles the neck and fastens to the bib body 10. Another contemplated fastener is simply pressure sensitive adhesive applied to the torso side of the bib body 10 that is pressed against the clothing of the user. The pressure sensitive adhesive may optionally have a peel-off cover.

The bib body 10 optionally has a neck portion 15 that approximately touches or encircles the neck. The neck portion 15 can be straight, arcuate or other shapes. It can have slits or notches that allow the neck portion 15 to fit a variety of sizes of necks and users.

Optionally, the bib cover 40 or second absorbent cover 41 can have on the outward side at least one attachment point 42, such as a VELCRO® loop and hook fastener, snap or button to attach objects such as toys or pacifiers. The cover 40 or second cover 41 can have pockets 43 to store or carry objects.

Further optionally, the cover 40 or second cover can have a large pocket 55 positioned approximately at the bottom of the bib to catch crumbs or liquid spills as the bib is used. The large pocket 55 can serve dual purposes, such as to carry toys, which are removed, and then the large pocket 55 is used to catch crumbs when food is consumed.

It is contemplated that in the use of this invention that the bib 1 can be packaged individually 44 or in containers having multiple bibs. It is further contemplated that the bibs can be manufactured in one long sheet of bibs 48 that has tear-off perforations 46. The long sheet can be distributed as a roll 47 with tear-off sheets 48.

The bib 1 is used by attaching fastening means 20 to the neck and placing the torso side of the bib 1 against the torso of the user. When the bib 1 is soiled, the soiled cover 40 and or second cover 41 is removed by pulling down, thereby exposing the wetted wipe 30. The bib body 10 with the wetted wipe 30 is manipulated to clean the hands and face of the user. The soiled bib 1 can be removed from the user and rolled up with the torso side of the bib body 10 outward to prevent spills or leaks. The bib1 is then disposed of.

In a second embodiment, the wetted wipe 30 is folded and attached to the bib body 10. Optionally, the folded wet wipe is enclosed in a water-tight packet. The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. A disposable bib for a user comprising a flexible bib body having bib body edges, wherein the bib body has a torso side and an outward side;

at least one fastener attached to the bib body to attach the bib to the user;

a flexible absorbent wetted wipe having wipe edges, wherein the wipe is fixably attached to the outward side of the bib body; wherein the wipe edges are within the bib body edges defining a border;

a flexible releasable cover sealingly attached with pressure sensitive or hot melt releasable adhesive to the border of the bib body, where the releasable cover fully covers the wipe; wherein the cover fully encloses and the adhesive seals the wipe between the bib body and the cover, and keeps the wipe wetted until the cover is removed; wherein the cover is configured to be removed from the bib body, thereby exposing the wipe, and wherein the wipe is configured to be manipulated to clean the user;

wherein the bib body and the releasable cover is made of water-impermeable material; and wherein a second absorbent removable cover is laminated to the outward side of the releasable cover and the second absorbent removable cover is removed with the releasable cover.

2. The bib of claim 1 wherein the at least one fastener is selected from the group consisting of two straps that encircle the neck of the user and fasten by either tying, adhesive, snaps, hooks, buttons or loop and hook fasteners; an unbroken circle that loops over the head of the user; and pressure sensitive adhesive on the torso side of the bib.

3. The bib of claim 1 wherein the absorbent wipe is approximately spread flat on the bib body.

4. The bib of claim 1 wherein the bib is packaged individually.

5. The bib of claim 1 wherein the bib is manufactured as one long sheet of bibs that have tear-off perforations.

6. The bib of claim 1 wherein the releasable cover or the second absorbent removable cover has on the outward side at least one attachment point.

7. The bib of claim 6 wherein the at least one attachment point is selected from the group consisting of a loop and hook fastener, a snap and a button.

8. The bib of claim 6 wherein the releasable cover or the second absorbent removable cover has a pocket.

9. The bib of claim 6 wherein the releasable cover or second absorbent removable cover has a large pocket positioned at the bottom of the bib.

10. The bib of claim 9 wherein the bib is packaged individually.

11. The bib of claim 9 wherein the bib is manufactured in one long sheet of bibs that has tear-off perforations.

12. The bib of claim 11 wherein the long sheet of bibs is on a roll.

13. A disposable bib for a user comprising a flexible bib body having bib body edges, wherein the bib body has a torso side and an outward side; at least one fastener attached to the bib body to attach the bib to the user; a flexible absorbent wetted wipe having wipe edges, wherein the wipe is fixably attached to the outward side of the bib body; wherein the wipe edges are within the bib body edges defining a border;

a flexible releasable cover sealingly attached with pressure sensitive or hot melt releasable adhesive to the border of the bib body, where the releasable cover fully covers the wipe; wherein the cover fully encloses and the adhesive seals the wipe between the bib body and the cover, and keeps the wipe wetted until the cover is removed; wherein the cover is configured to be removed from the bib body, thereby exposing the wipe, and wherein the wipe is configured to be manipulated to clean the user, and wherein the bib body and the releasable cover is made of water-impermeable material, and wherein the at least one fastener is selected from the group comprising two straps that encircle the neck of the user and fasten by either tying, adhesive, snaps, hooks, buttons or loop and hook fasteners; an unbroken circle that loops over the head of the user; and pressure sensitive adhesive applied to the torso side of the bib.

14. The bib of claim 13 wherein the bib is packaged individually.

15. The bib of claim 13 wherein the bib is manufactured as one long sheet of bibs that have tear-off perforations.

16. The bib of claim 13 wherein the absorbent wipe is approximately spread flat on the bib body.

17. A disposable bib for a user comprising a flexible bib body having bib body edges, wherein the bib body has a torso side and an outward side; at least one fastener attached to the bib body to attach the bib to the user; a flexible absorbent wetted wipe having wipe edges, wherein the wipe is fixably attached to the outward side of the bib body; wherein the wipe edges are within the bib body edges defining a border;

a flexible releasable cover sealingly attached with pressure sensitive or hot melt releasable adhesive to the border of the bib body, where the releasable cover fully covers the wipe; wherein the cover fully encloses and the adhesive seals the wipe between the bib body and the cover, and keeps the wipe wetted until the cover is removed; wherein the cover is configured to be removed from the bib body, thereby exposing the wipe, and wherein the wipe is configured to be manipulated to clean the user;

wherein the bib body and the releasable cover is made of water-impermeable material; and wherein the at least one fastener is selected from the group comprising two straps that encircle the neck of the user and fasten by either tying, adhesive, snaps, hooks, buttons or loop and hook fasteners; an unbroken circle that loops over the head of the user; and pressure sensitive adhesive applied to the torso side of the bib, and wherein the absorbent wipe is approximately spread flat on the bib body.

* * * * *